US011542960B1

(12) United States Patent
Chen et al.

(10) Patent No.: US 11,542,960 B1
(45) Date of Patent: Jan. 3, 2023

(54) CENTRIFUGAL FAN NOISE-LOWERING STRUCTURE

(71) Applicant: ASIA VITAL COMPONENTS CO., LTD., New Taipei (TW)

(72) Inventors: Yu-Tzu Chen, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 17/467,472

(22) Filed: Sep. 7, 2021

(51) Int. Cl.
*F04D 29/66* (2006.01)
*F04D 17/16* (2006.01)
*F04D 29/058* (2006.01)

(52) U.S. Cl.
CPC ..... *F04D 29/667* (2013.01); *F04D 17/16* (2013.01); *F04D 29/058* (2013.01); *F05D 2240/12* (2013.01); *F05D 2240/20* (2013.01); *F05D 2240/515* (2013.01); *F05D 2260/96* (2013.01)

(58) Field of Classification Search
CPC ..... F04D 29/667; F04D 29/64; F04D 29/058; F04D 29/327; F04D 29/4226; F04D 29/424; F04D 29/441; F04D 29/659; F04D 29/281; F04D 17/162; F04D 17/164; F04D 19/002; F04D 19/007; H05K 7/20172; H05K 7/20; H05K 7/20718; H05K 7/20136; G06F 1/203
See application file for complete search history.

(56) References Cited

U.S. PATENT DOCUMENTS 9,206,808 B2 * 12/2015 Yuan ..... F04D 29/281
2008/0226446 A1 * 9/2008 Fujieda ..... F04D 29/281 415/203
2013/0084187 A1 * 4/2013 Wu ..... F04D 17/162 416/189
2014/0017075 A1 * 1/2014 Wu ..... F04D 29/626 415/203

* cited by examiner

*Primary Examiner* — Eldon T Brockman
*Assistant Examiner* — Maxime M Adjagbe
(74) *Attorney, Agent, or Firm* — Bradley J. Thorson; DeWtt LLP

(57) ABSTRACT

A centrifugal fan noise-lowering structure includes a frame having an upper and a lower cover and a sidewall, which together internally define a receiving space communicable with an air inlet and an air outlet of the frame; a stator assembly located in the receiving space and fixedly mounted on the lower cover; and a rotor assembly correspondingly assembled to the stator assembly. The receiving space is internally defined a high pressure zone and a low pressure zone. The upper cover is provided with an airflow passage, which has an inlet located at a position corresponding to the high pressure zone, and an outlet located at a position corresponding to the low pressure zone. With the airflow passage, air in the high pressure zone can be guided to jet out to the low pressure zone to thereby reduce noise produced by the centrifugal fan during its operation.

5 Claims, 3 Drawing Sheets

CENTRIFUGAL FAN NOISE-LOWERING STRUCTURE

FIELD OF THE INVENTION

The present invention relates to a centrifugal fan noise-lowering structure, and more particularly, to a centrifugal fan noise-lowering structure that includes an airflow passage provided on an upper cover or a lower cover of the centrifugal fan for guiding air to jet out to a low pressure zone in the fan, so as to reduce the noise produced by the fan during its operation.

BACKGROUND OF THE INVENTION

Since centrifugal fans, centrifugal compressors, centrifugal blowers and centrifugal pumps have the advantages of being capable of changing the flowing direction of a fluid (i.e. having fluid inlet and fluid outlet oriented to different directions), utilizing a centrifugal force to further increase the pressure of the fluid, being highly adaptable to different spaces (applicable to narrow space in, for example, a notebook computer for heat dissipation), and being simple in structure, they have wide applications in daily life, such as being used in notebook computers, hair dryers, vacuum cleaners, bathroom exhaust fans, kitchen range hoods, air-conditioning or related ventilation system for car engines, industrial equipment, and water-cooling towers. However, centrifugal fans, compressors, blowers and pumps would produce noise during their operation to form a serious and unacceptable problem. It is therefore necessary to improve the noise problem of the centrifugal type machines.

Most currently available centrifugal fan noise-lowering structures are focused on the optimization of the structural design of fan, such as adjusting the shape of fan blades, the geometry of air inlet, the style of volute, the throat gap design and the number of air guiding structures; or the mounting of additional active noise-eliminating devices or deafening devices. The conventional optimized structural designs have the disadvantage of narrow scope of application. That is, the locally optimized structural designs are uneasy to be widely applied. Usually, many optimized structural parameters must be re-calculated once the environment and operating conditions are changed. On the other hand, the mounting of additional noise-eliminating devices has the drawback of largely increased materials and manufacturing cost and occupying more space.

It is therefore an important target of the technical persons in this field to solve the disadvantages in the conventional centrifugal fan noise-lowering structures.

SUMMARY OF THE INVENTION

To effectively solve the above problems, a primary object of the present invention is to provide an airflow passage on one or both of an upper cover and a lower cover of a centrifugal fan for guiding air to jet out from a high pressure zone to a low pressure zone in a frame of the centrifugal fan, so as to reduce the noise produced by the centrifugal fan during its operation.

To achieve the above and other objects, the present invention provides a centrifugal fan noise-lowering structure. In a first embodiment, the centrifugal fan noise-lowering structure includes a frame, a stator assembly and a rotor assembly.

The frame has an upper cover, a lower cover and a sidewall. The upper cover is provided with an airflow passage, which has two opposite ends forming an inlet and an outlet, respectively. The upper cover, the lower cover and the sidewall together internally define a receiving space, which is communicable with an air inlet and an air outlet of the frame. The receiving space is internally defined a high pressure zone and a low pressure zone; the inlet of the airflow passage is located at a position corresponding to the high pressure zone, and the outlet of the airflow passage is located at a position corresponding to the low pressure zone. The stator assembly is located in the receiving space and fixedly mounted to an inner side of the lower cover; and the rotor assembly is correspondingly assembled to the stator assembly.

To achieve the above and other objects, a second embodiment of the centrifugal fan noise-lowering structure according to the present invention includes a frame, a stator assembly and a rotor assembly.

The frame has an upper cover, a lower cover and a sidewall. The upper cover is provided with a first airflow passage, and the lower cover is provided with a second airflow passage. The first airflow passage has two opposite ends forming a first inlet and a first outlet, respectively; and the second airflow passage has two opposite ends forming a second inlet and a second outlet, respectively. The upper cover, the lower cover and the sidewall together internally define a receiving space, which is communicable with an air inlet and an air outlet of the frame. The receiving space is internally defined a high pressure zone and a low pressure zone. The first and second inlets of the first and second airflow passages are located at positions corresponding to the high pressure zone, and the first and second outlets of the first and second airflow passages are located at positions corresponding to the low pressure zone. The stator assembly is located in the receiving space and fixedly mounted to an inner side of the lower cover; and the rotor assembly is correspondingly assembled to the stator assembly.

According to the present invention, the provision of the airflow passage on one or both of the upper cover and the lower cover can effectively guide air to jet out from the high pressure zone to the low pressure zone in the frame of the centrifugal fan to thereby reduce the noise produced by the centrifugal fan during its operation.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
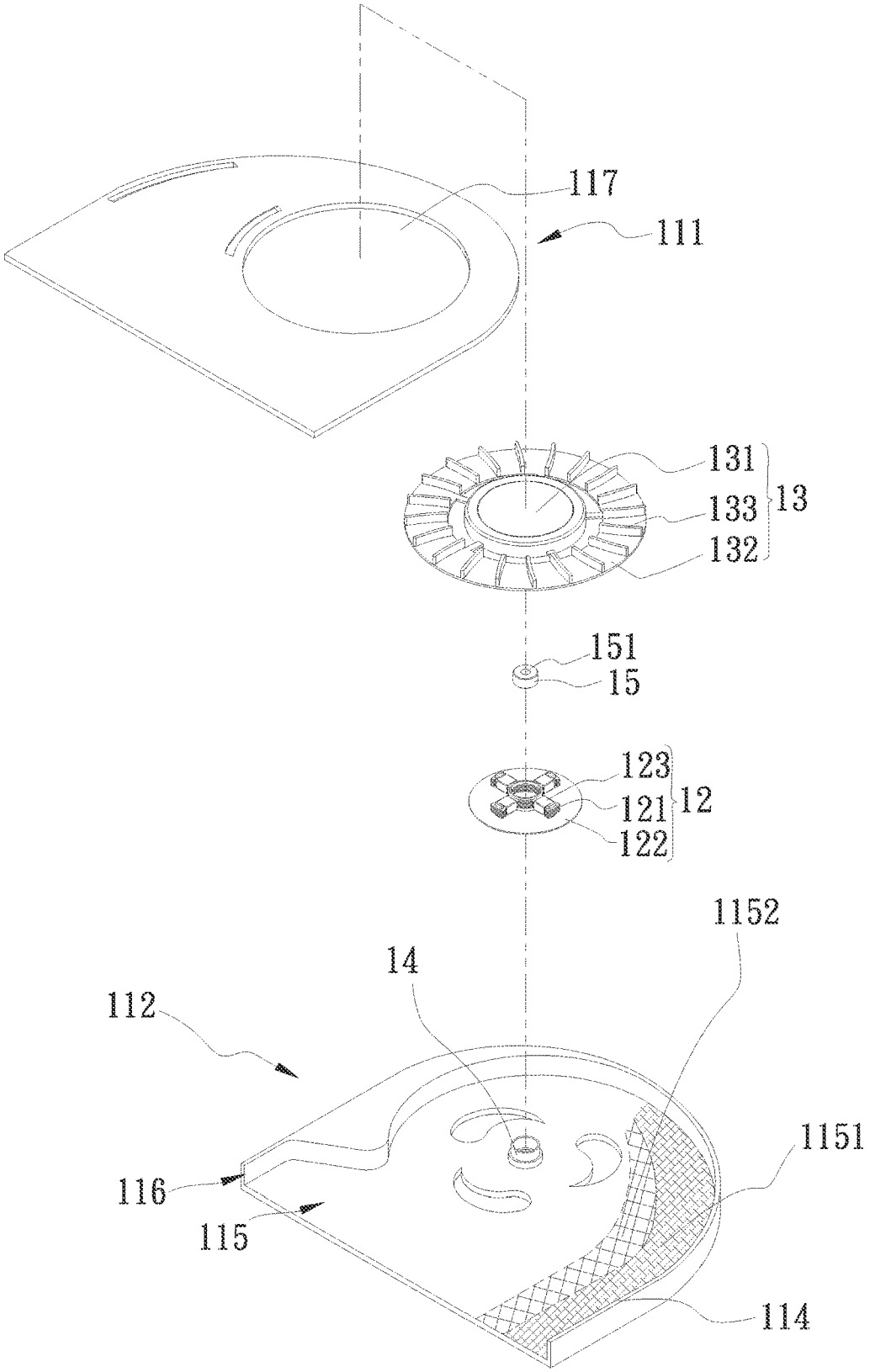
FIG. 1 is an exploded perspective view of a centrifugal fan noise-lowering structure according to a preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
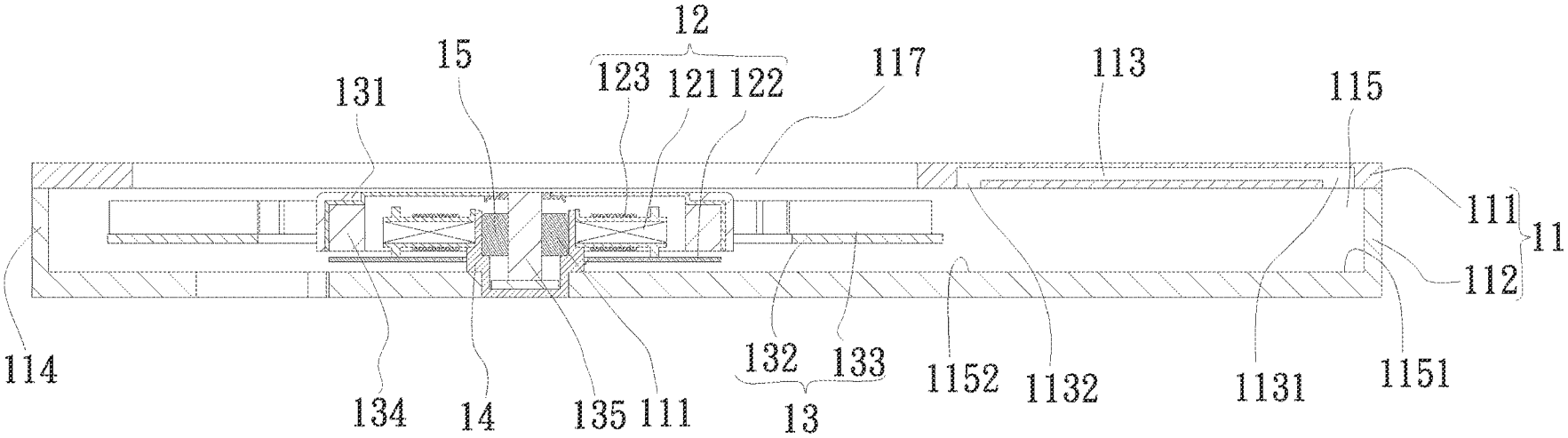
FIG. 2 is an assembled sectional view of FIG. 1.

Please refer to FIGS. 1 and 2, which are exploded perspective view and assembled sectional view, respectively, of a centrifugal fan noise-lowering structure according to a preferred embodiment of the present invention. As shown, the centrifugal fan noise-lowering structure includes a frame 11, a stator assembly 12 and a rotor assembly 13.

The frame 11 includes an upper cover 111, a lower cover 112 and a sidewall 114. The upper cover 111 is provided with an airflow passage 113, which has two ends forming an inlet 1131 and an outlet 1132, respectively. The sidewall 114 is perpendicularly formed along an outer periphery of the lower cover 112, such that the upper cover 111, the lower cover 112 and the sidewall 114 together define a receiving space 115 between them. An air outlet 116 is formed at one side of the lower cover 112, and an air inlet 117 is formed on the upper cover 111 at a location corresponding to the rotor assembly 13. The receiving space 115 is communicable with the air outlet 116 and the air inlet 117.

The receiving space 115 is internally defined a high pressure zone 1151 and a low pressure zone 1152. The high pressure zone 1151 is located in the receiving space 115 farther away from the rotor assembly 13 and closer to an area of the lower cover 112 adjacent to the sidewall 114. On the other hand, the low pressure zone 1152 is located in the receiving space 115 closer to the rotor assembly 13. The inlet 1121 of the airflow passage 113 is located at a position corresponding to the high pressure zone 1151, and the outlet 1132 of the airflow passage 113 is located at a position corresponding to the low pressure zone 1152.

The stator assembly 12 is located in the receiving space 115 and fixedly mounted on an inner side of the lower cover 112. The stator assembly 12 includes a plurality of silicon steels 121 and a circuit board 122. The silicon steels 121 are stacked together and wound by a plurality of coils 123. The coils 123 are electrically connected to the circuit board 122.

The rotor assembly 13 is correspondingly assembled to the stator assembly 12. The rotor assembly 13 includes a hub 131, a disc-shaped section 132 radially outward extended from the hub 131, a plurality of fan blades 133 formed on the disc-shaped section 132, magnetic bodies 134 provided in the hub 131, and a shaft 135 perpendicularly extended from an inner side of the hub 131 toward the stator assembly 12. The magnetic bodies 134 and the silicon steels 121 are excited due to mutual induction.

A bearing cup 14 is perpendicularly formed on the inner side of the lower cover 112. At least one bearing 15 is set in the bearing cup 14 to define a shaft hole 151, in which the shaft 135 is inserted. The silicon steels 121 and the circuit board 122 of the stator assembly 12 are fitted around an outer side of the bearing cup 14.

The present invention is described with a centrifugal fan. In a preferred embodiment thereof, the inlet 1131 of the airflow passage 113 of the fame 11 is located at the upper cover 111 near a radially outer side thereof to correspond to the high pressure zone 1151; and the outlet 1132 of the airflow passage 113 of the frame 11 is located at the upper cover 111 near a throat thereof to correspond to the low pressure zone 1152. In the preferred embodiment, the entire airflow passage 113 is formed in the upper cover 111. The outlet 1132 defines a jet flow, which is located at a throat gap between the sidewall 114 and the rotor assembly 13. The jet flow formed at this location can improve a recirculation zone at the throat (see FIG. 1) by reducing flow field pressure fluctuation in the recirculation zone and accordingly lowering the noise produced by the centrifugal fan during operation thereof.

More specifically, the inlet 1131 of the airflow passage 113 is provided at a location corresponding to the high pressure zone 1151 and the outlet 1132 of the airflow passage 113 is provided at a location corresponding to the low pressure zone 1152. When the fan blades 133 of the rotor assembly 13 are rotated, air is forced and guided into the high pressure zone 1151 and the low pressure zone 1152. The air is forced and guided by the rotor assembly 13 to flow into the airflow passage 113 via the inlet 1131 and then flows out of the airflow passage 113 via the outlet 1132. In this way, the air can jet out of the outlet 1132 to the low pressure zone 1152 closer to the rotor assembly 13 to thereby achieve a noise lowering effect. The airflow passage 113 can be selectively provided on the upper cover 111 or the lower cover 112, or on both of the upper cover 111 and the lower cover 112 (not shown). In the illustrated preferred embodiment, the airflow passage 113 is provided on the upper cover 111. However, it is understood the present invention is not particularly limited thereto.

Figure 3:
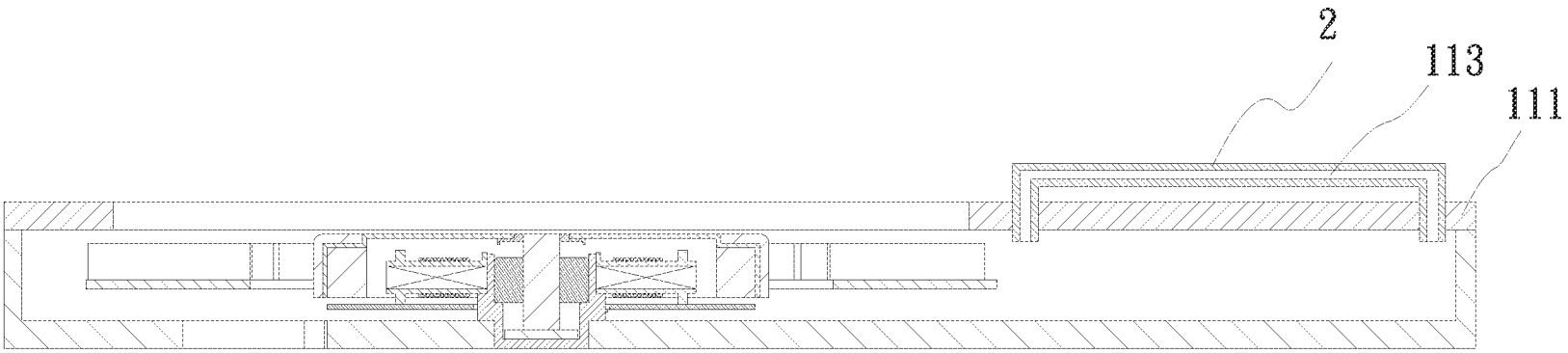
FIG. 3 is an assembled sectional view of another embodiment of the centrifugal fan noise-lowering structure of the present invention.

Please refer to FIG. 3, which is an assembled sectional view of another embodiment of the centrifugal fan noise-lowering structure according to the present invention. This embodiment is generally structurally similar to the preferred embodiment but has an airflow passage 113 in the form of a pipe 2. The pipe 2 is selectively provided on the upper cover 111 or the lower cover 112, or is connected to between the upper cover 111 and the lower cover 112. In this embodiment, the pipe 2 is not integrally formed with the upper and the lower cover 111, 112 but is additionally assembled to the upper cover 111 and/or the lower cover 112. In FIG. 3, the illustrated pipe 2 is connected at two ends to the upper cover 111. However, it is understood the present invention is not particularly limited thereto.

In the above embodiments, there can be a plurality of airflow passages 113 provided on the frame 11. Further, the inlet 1131 and the outlet 1132 can have a round, a square, a triangular or a trapezoidal cross sectional shape; and the airflow passage 113 can have a cross sectional shape the same as or different from that of the inlet 1131 and the outlet 1132.

The present invention is described with a centrifugal fan, and is characterized by providing an airflow passage on the upper cover or the lower cover of the centrifugal fan. When the rotor assembly rotates, a pressure difference is naturally formed at two opposite ends of the airflow passage due to the feature of a rotational machine, such that the flowing of air from the high pressure zone through the airflow passage to the low pressure zone can achieve a natural and self jetting effect. Since the fan noise is generated mainly due to the fluctuation of pressure in the air flow, the self jetting is able to accurately control the uneven low pressure zone or the low speed zone near the rotor assembly to thereby reduce the pressure fluctuation of the air flow in the low pressure or low speed zone and accordingly, reduce the noise generated by the fan during its operation.

In view that the rotor assembly and the volute, i.e. the frame, of the centrifugal fan tend to produce uneven low pressure/low speed zone, and that the fan noise is usually generated at some fixed positions, such as radial outer ends of fan blades near the air outlet, the throat, and areas between the upper and lower covers and the fan blades, the centrifugal fan noise-lowering structure of the present invention that utilizes self jet to lower fan noise can be widely applied to different centrifugal designs and operating conditions.

Further, since most of the centrifugal fans have upper and lower covers made of a metal material, it is relatively easy to add the airflow passage to the upper and/or the lower cover to achieve the noise-lowering structure. The centrifugal fan noise-lowering structure of the present invention has the advantages of wide applications, not requiring additional manufacturing equipment, and not requiring complicated structural design. With the structurally simple airflow passage, it is possible to improve the problems in the flow field, such as vortex and secondary flow appeared between the rotor assembly and the fan frame. The present invention not only enhances the feature of the centrifugal fan, but also lowers the noise generated by the centrifugal fan during its operation.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A centrifugal fan noise-lowering structure, comprising:

a frame having an upper cover, a lower cover and a sidewall; the upper cover being provided with an airflow passage, which has two opposite ends forming an inlet and an outlet, respectively; the upper cover, the lower cover and the sidewall together internally defining a receiving space, which is communicable with an air inlet and an air outlet of the frame; the receiving space being internally defined by a high pressure zone and a low pressure zone; the inlet of the airflow passage being located at a position corresponding to the high pressure zone, and the outlet of the airflow passage being located at a position corresponding to the low pressure zone;

a stator assembly being located in the receiving space and fixedly mounted on an inner side of the lower cover; and a rotor assembly being correspondingly assembled to the stator assembly.

2. The centrifugal fan noise-lowering structure as claimed in claim 1, wherein the air outlet is provided on one side of the lower cover, and the air inlet is provided on the upper cover at a location corresponding to the rotor assembly.

3. The centrifugal fan noise-lowering structure as claimed in claim 1, wherein the high pressure zone is located in the receiving space farther away from the rotor assembly and closer to an area of the lower cover adjacent to the sidewall, and the low pressure zone is located in the receiving space closer to the rotor assembly.

4. The centrifugal fan noise-lowering structure as claimed in claim 1, wherein the rotor assembly includes a hub, a disc-shaped section radially outward extended from the hub, a plurality of fan blades formed on the disc-shaped section, magnetic bodies provided in the hub, and a shaft perpendicularly extended from an inner side of the hub toward the stator assembly; and the stator assembly includes a plurality of silicon steels stacked together and wound by a plurality of coils, a circuit board electrically connected to the coils, a bearing cup perpendicularly formed on the inner side of the lower cover, and at least one bearing set in the bearing cup and defining a shaft hole, in which the shaft is inserted; and the silicon steels and the circuit board being fitted around an outer side of the bearing cup.

5. The centrifugal fan noise-lowering structure as claimed in claim 1, wherein the airflow passage is integrally formed with the upper cover.

* * * * *